US005249480A

United States Patent [19]

Harmon et al.

[11] Patent Number: 5,249,480

[45] Date of Patent: Oct. 5, 1993

[54] TWO HANDLED CONTROLLER FOR A LOCOMOTIVE

[75] Inventors: Kevin E. Harmon, Erie; John B. Bendig, Waterford; Dennis Mahoney, Erie, all of Pa.

[73] Assignee: General Electric Company, Erie, Pa.

[21] Appl. No.: 788,665

[22] Filed: Nov. 6, 1991

Related U.S. Application Data

[63] Continuation-in-part of Ser. No. 629,775, Dec. 18, 1990, Pat. No. 5,134,895.

[51] Int. Cl.[5] ..... G05G 11/00

[52] U.S. Cl. ..... 74/483 R; 74/483 K; 74/491; 192/0.94; 192/1.1; 192/1.54

[58] Field of Search ..... 74/491, 470, 483 R, 74/483 K; 192/1.52, 1.55, 1.56, 2, 3, 0.90–0.98, 1.38, 1.1, 1.4, 1.21, 1.52, 1.55, 1.56, 0.90–0.98

[56] References Cited

U.S. PATENT DOCUMENTS

| | | | |
|---|---|---|---|
| 166,026 | 7/1875 | Moschcowitz . | |
| 564,632 | 7/1896 | Mitchell . | |
| 576,384 | 2/1897 | Thomas et al. . | |
| 634,832 | 10/1899 | Pearson . | |
| 872,732 | 12/1907 | Johnson . | |
| 1,161,006 | 10/1915 | Muzzy . | |
| 2,025,262 | 12/1935 | Anderson | 60/16 |
| 2,202,551 | 5/1940 | Guffy | 192/1 |
| 2,249,955 | 7/1941 | Hewitt | 192/2 |
| 2,290,962 | 7/1942 | Hewitt | 192/155 |
| 2,647,415 | 8/1953 | Dean et al. | 74/483 R |
| 2,667,247 | 1/1954 | May | 192/3 |
| 3,390,921 | 7/1968 | Klimek | 74/490 |
| 3,638,770 | 2/1972 | Frill et al. | 192/1.54 |
| 3,842,653 | 10/1974 | Blonn, Sr. | 74/483 R |
| 4,111,062 | 9/1978 | Callaghan | 74/470 |
| 4,195,534 | 4/1980 | Prince | 74/491 |
| 4,310,026 | 1/1982 | Oliver et al. | 74/491 |
| 4,796,480 | 1/1989 | Amos et al. | 74/483 |

*Primary Examiner*—Carl D. Friedman
*Assistant Examiner*—Winnie Yip
*Attorney, Agent, or Firm*—R. Thomas Payne

[57] ABSTRACT

The present invention is directed to a controller having a power handle to control both the propulsion function and the braking function, and a reverser handle to control the direction in which the locomotive travels. The power handle is operatively connected to a propulsion and brake control device which controls the propulsion and braking functions of the locomotive, while the reverser handle is operatively connected to a reverser control device which controls direction of travel. The propulsion and brake control device preferably includes a propulsion controller to control the propulsion function of the locomotive, a braking controller to control the braking function and an indexing mechanism to independently operate either the propulsion controller or the braking controller. The indexing mechanism preferably includes a drive gear operatively connected to the propulsion controller via a first lost motion device which controls the propulsion function when the power handle is moved in a first direction and to the braking controller via a second lost motion device which controls the braking function when the power handle is moved in a second direction. In order to insure mutually exclusive movement of either the propulsion controller or the braking controller, a throttle-brake interlock is preferably provided. Additionally, in order to provide tactile feedback to the user on the movement of the power handle, a detent mechanism is preferably provided.

19 Claims, 9 Drawing Sheets

TWO HANDLED CONTROLLER FOR A LOCOMOTIVE

CROSS-REFERENCE TO RELATED APPLICATION(S)

The present application is a continuation-in-part of U.S. patent application Ser. No. 07/629,775 entitled "Controller For A Vehicle" by Harmon and Bendig, filed Dec. 18, 1990, now U.S. Pat. No. 5,134,895, assigned to the same assignee as the present application and incorporated herein by reference.

BACKGROUND OF THE INVENTION

The present invention is directed to a two-handled controller for operating a vehicle. More particularly, the present invention is directed to a controller having a power handle, to control both the propulsion function and the braking function, and a reverser handle, to control the direction in which the vehicle travels.

The present invention finds particular utility in the field of railway locomotives, such as those powered by a diesel engine.

Controllers for railway locomotives are well known in the art. For example, in U.S. Pat. No. 3,842,653 to Blonn, Sr. and herein incorporated by reference, a three-handled controller is disclosed for controlling the throttle, direction and dynamic braking functions of a diesel electric locomotive. Each handle is operatively connected to a set of control cams which, when rotated by the respective handle, cause electrical contacts to be closed, thereby individually controlling the throttle, direction and dynamic braking functions.

Two-handled controllers for controlling the throttle, direction and dynamic braking functions of a diesel electric locomotive are also known in the art. For example, U.S. Pat. No. 2,290,962 to Hewitt and herein incorporated by reference discloses a handle which controls both throttle and dynamic braking completely by electrical means. Additionally, U.S. Pat. No. 4,796,480 to Amos et al. and herein incorporated by reference discloses a handle which controls both throttle and dynamic braking via electro-mechanically.

SUMMARY OF THE INVENTION

It is an object of the present invention to provide a two-handled controller to control the propulsion, braking and direction of travel of a vehicle, such as a locomotive.

It is another object of the present invention to provide a controller having a power handle to control both the propulsion function and the braking function, and a reverser handle to control the direction in which the locomotive travels.

It is a further object of the present invention to provide a throttle-brake interlock which provides mutual exclusivity between the propulsion function and the braking function.

In accordance with these and other objects, the present invention is directed to a controller having a power handle to control both the propulsion function and the braking function, and a reverser handle to control the direction in which the locomotive travels. The power handle is operatively connected to a propulsion and brake control device which controls the propulsion and braking functions of the locomotive, while the reverser handle is operatively connected to a reverser control device which controls direction of travel.

The propulsion and brake control device preferably includes a propulsion controller to control the propulsion function of the locomotive, a braking controller to control the braking function and an indexing mechanism to independently operate either the propulsion controller or the braking controller.

The propulsion controller preferably comprises a plurality of propulsion control cams mounted on a shaft. Similarly, the braking controller preferably comprises a plurality of braking control cams mounted on another shaft. As each cam is rotated, a spring-biased contact finger associated with each cam engages a fixed contact member.

The fingers and fixed contact members associated with the propulsion control cams form a plurality of switches which, when closed, send electrical signals to a control processor which controls the propulsion of the locomotive.

Similarly, the fingers and fixed contact members associated with the braking control cams form a plurality of switches which, when closed, send electrical signals to a control processor. A potentiometer is also preferably connected to the shaft about which the braking control cams rotate. The resistance of the potentiometer is indicative of the amount of shaft rotation. The processor controls the braking function of the locomotive, based on the signals from the switches and the resistance of the potentiometer.

The specific contour of the propulsion and braking control cams, along with their relative angular position with respect to each other, is preferably such that their respective contact fingers are engagable with the fixed contact members to provide a desired propulsion and braking profile, respectively.

The indexing mechanism, which independently operates either the propulsion controller or the braking controller, preferably includes a drive gear which is rotatably mounted on a shaft. The drive gear is preferably movable in a first direction for initiating rotational motion of the shaft about which the propulsion control cams are located, and in a second direction for initiating rotational motion of the shaft about which the braking control cams are located.

The drive gear is operatively connected to the power handle. Thus, movement of the power handle controls either the propulsion or the braking function. The drive gear is operatively connected to the propulsion controller via a first lost motion device which causes rotation of the shaft about which the propulsion control cams are located when the power handle is moved in the first direction. Similarly, the drive gear is operatively connected to the braking controller via a second lost motion device which causes rotation of the shaft about which the braking control cams are located when the power handle is moved in the second direction.

Specifically, the power handle is preferably movable in a clockwise direction from a central idle position, where no braking power is applied, to a set-up position and into a brake control zone where braking power is applied. Clockwise movement of the power handle causes the drive gear to rotate clockwise, and the amount of braking power is preferably a function of the amount of clockwise rotation of the drive gear.

Similarly, the power handle is preferably movable in a counterclockwise direction from a central idle position into a throttle zone where propulsion is applied to the locomotive. Counterclockwise movement of the power handle causes the drive gear to rotate counterclockwise, and the amount of propulsion power is preferably a function of the amount of counterclockwise rotation of the drive gear.

In the preferred embodiment, the power handle is movable from the idle position to a plurality of discrete drive positions within the throttle zone. In order to provide tactile feedback to the user as the power handle is moved to each discrete drive position within the throttle zone, a detent mechanism is preferably provided. The detent mechanism preferably also provides tactile feedback to the user as the power handle is moved from the idle position, to the set up position and into the brake zone.

In order to insure mutually exclusive movement of either the propulsion controller or the braking controller, a throttle-brake interlock is preferably provided. In the preferred embodiment, the throttle-brake interlock is located between a braking control cam and a propulsion control cam.

The propulsion control cam and braking control cam associated with the throttle-brake interlock each include a notch. The throttle-brake interlock preferably comprises a movable arm having a first and a second roller rotatably mounted thereon.

While the braking function is active, the braking control cam is in motion and the first roller is in contact with and traveling along the periphery thereof. The arm is urged towards the propulsion control cam, causing the second roller to seat within the notch of the propulsion control cam. Rotation of propulsion control cam is therefore precluded.

Once the power handle is in the idle position, the first roller is aligned with the notch on the braking control cam. Should the propulsion function then become active, the propulsion control cam rotates, causing the second roller to travel along the periphery of the propulsion control cam. The arm is thus urged towards the braking control cam, causing the first roller to seat within the notch on the braking control cam, precluding further rotation of the braking control cam.

The reverser control device preferably comprises a plurality of reverser cams which are rotatably mounted on a shaft. The reverser cams are operatively connected to the reverser handle by appropriate linkage.

The reverser handle is movable from a central neutral position to a forward or reverse position, permitting an operator to control the direction in which the locomotive travels. As the reverser handle is moved, the reverser cams are rotated about a shaft and actuate directional switches used by the control processor to control the direction in which the locomotive travels.

The controller preferably also includes an interlock mechanism to help minimize operator error regarding reverser and power handle operation. Specifically, to be able to warm up the engine, the power handle can enter the throttle zone provided the reverser handle is in its neutral position. To engage a direction, however, the power handle must preferably be returned to its neutral position. Once the reverser handle has engaged either the forward or reverse direction, the power handle can be moved throughout the brake and throttle zones. To help prevent movement of the reverser handle while it is engaged in its forward or reverse positions, the reverser handle can preferably be moved only when the power handle is in its neutral position.

DETAILED DESCRIPTION OF THE PREFERRED EMBODIMENT(S)

Figure 1:
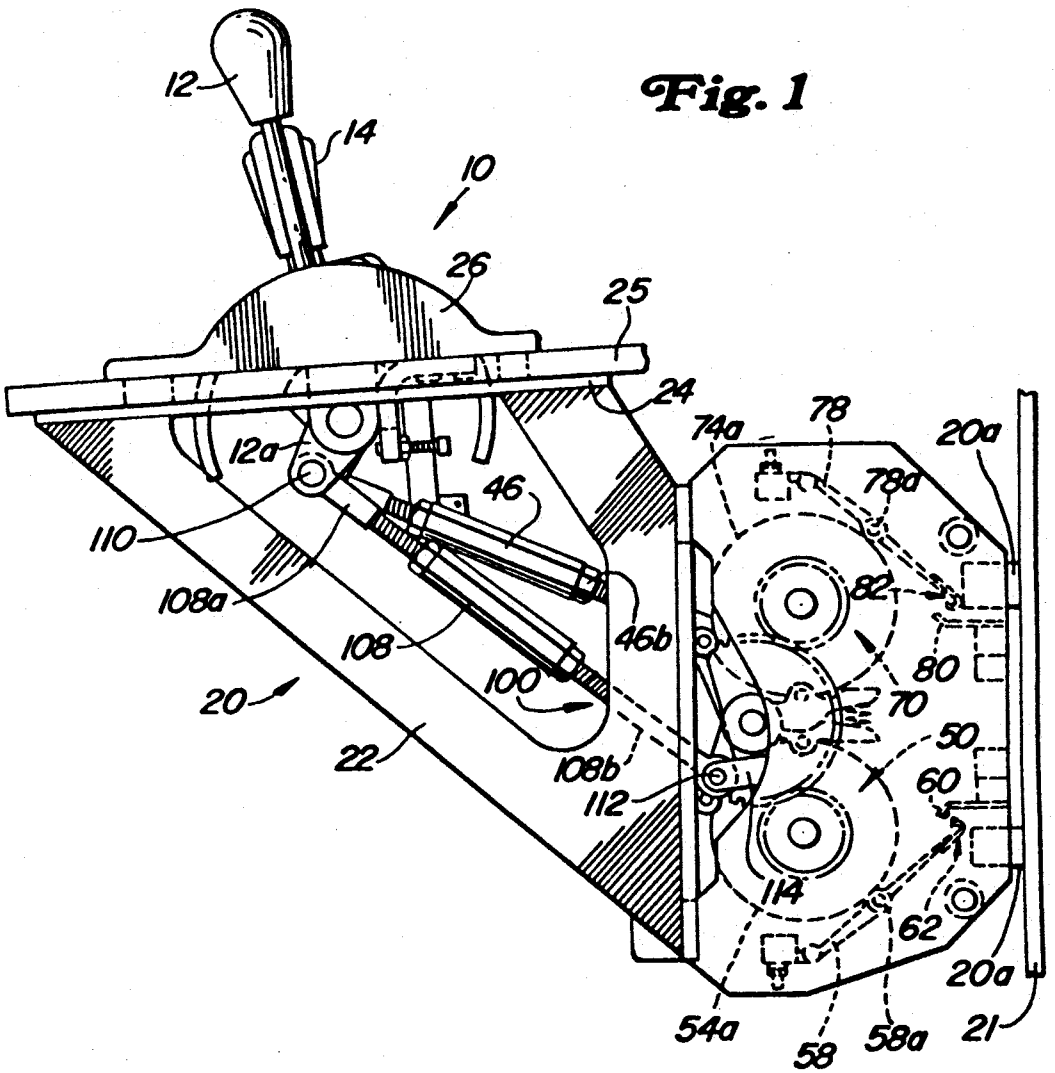
FIG. 1 illustrates a side view of the preferred embodiment of the controller of the present invention.
Figure 2:
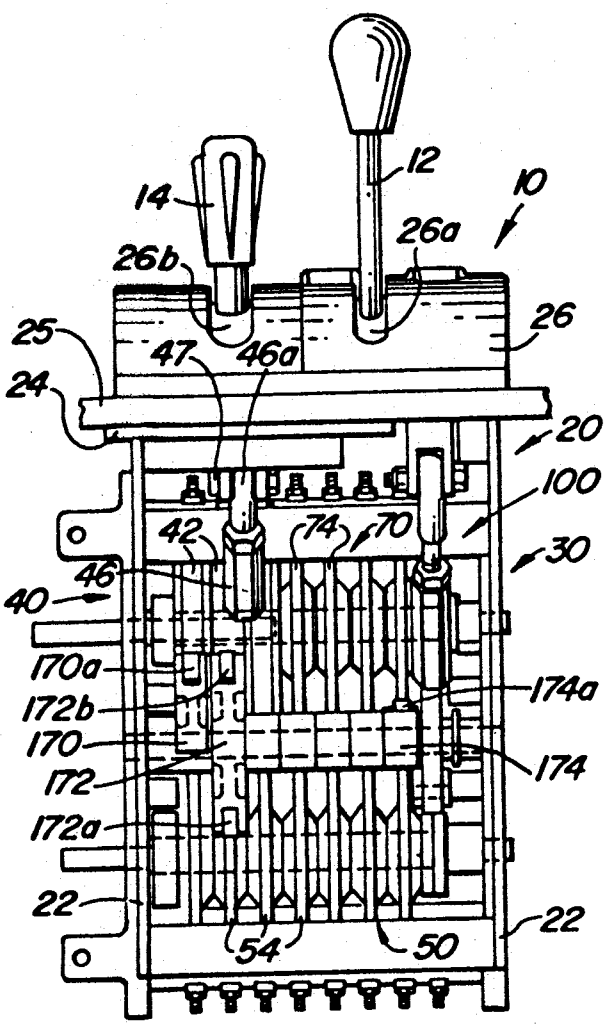
FIG. 2 illustrates a front view of the preferred embodiment of the controller shown in FIG. 1.

Turning now to FIGS. 1 and 2, controller 10 of the present invention is shown mounted in casing 20 comprising side plates 22 and upper plate 24. Casing 20 is fixed by brackets **20*a* or the like to a portion of cab frame 21 in a locomotive. Attached to upper plate 24 is a portion of console 25 and top cover 26, including guide slots 26*a* and 26*b* located therein. Extending through guide slots 26*a* and 26*b* are manually-actuated power handle 12 and reverser handle 14, respectfully. Power handle 12 operates propulsion and brake control device 30, which controls the propulsion and braking functions of the locomotive. Reverser handle 14 operates reverser control device 40**, which controls the direction (e.g., forward or reverse) in which the locomotive can be driven.

Figure 3:
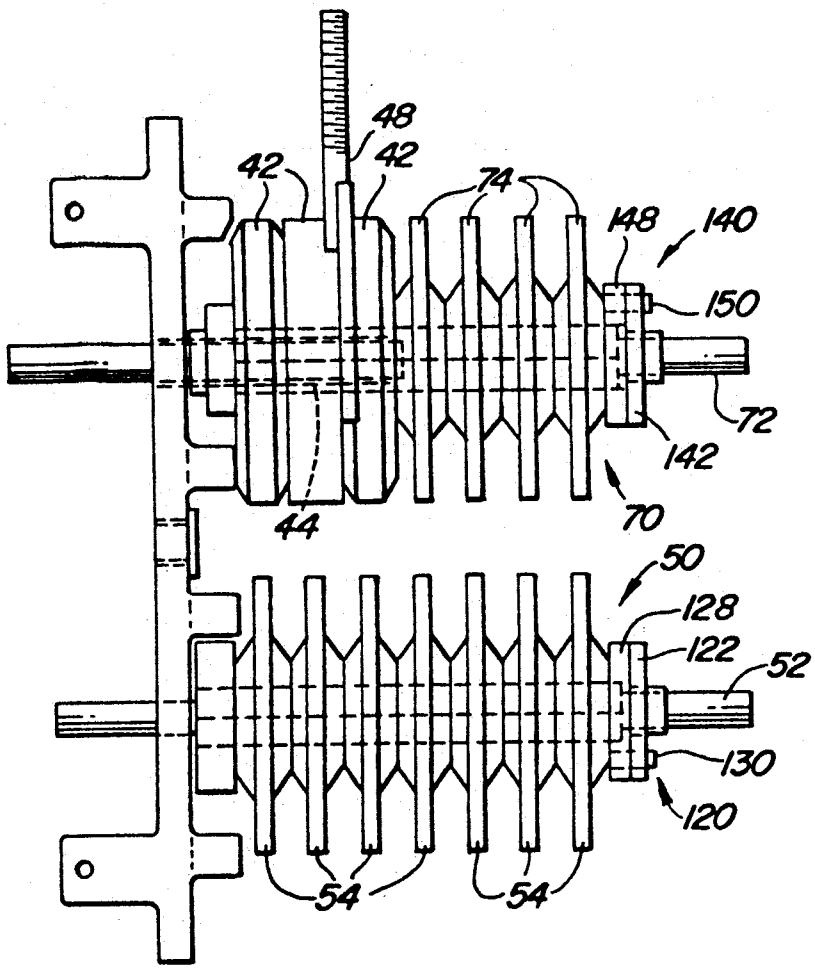
FIG. 3 shows an isolated side view of the propulsion controller, braking controller and a portion of the indexing mechanism of the controller shown in FIGS. 1 and 2.

As shown with reference to FIGS. 1 through 3, propulsion and brake control device 30 includes propulsion controller 50 to control the propulsion function of the locomotive, braking controller 70 to control the braking function and indexing mechanism 100 to independently operate propulsion controller 50 and braking controller 70. Indexing mechanism 100, operable by power handle 12, permits an operator to selectively control either the propulsion or the braking function of the locomotive via a single handle.

Figure 5:
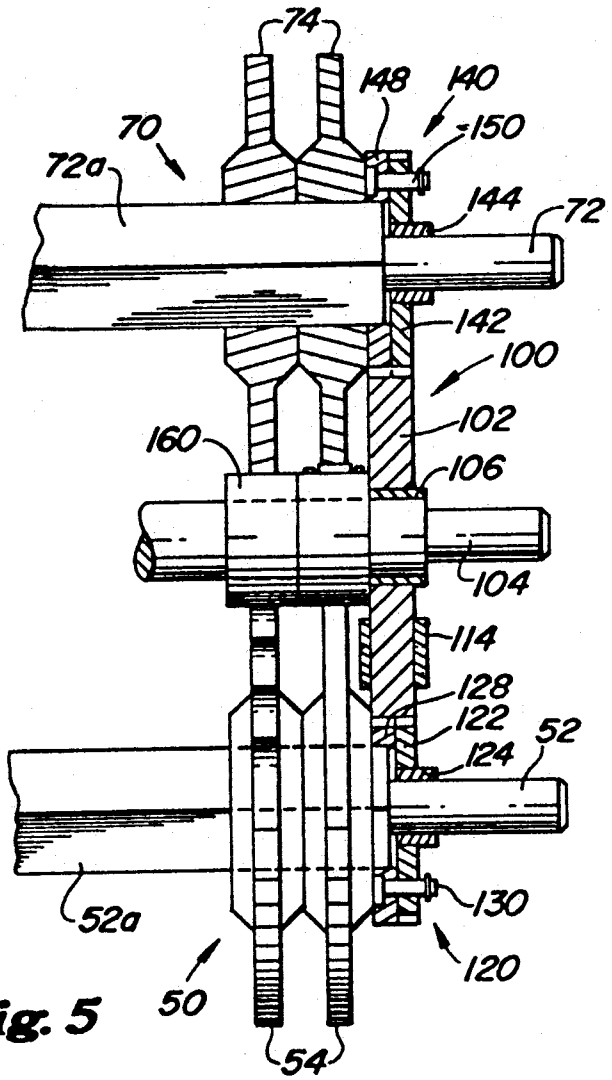
FIG. 5 is a partial cross-sectional view along line 5—5 in FIG. 4.
Figure 4A:
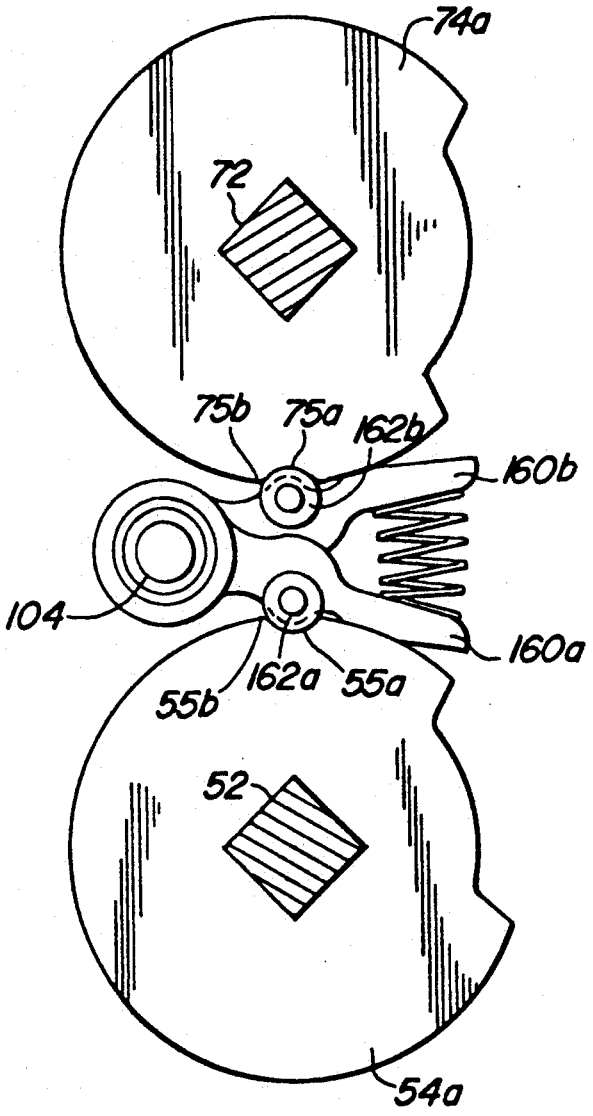

With reference to FIGS. 3 and 5, propulsion controller 50 comprises shaft 52 having a plurality of propulsion control cams 54 mounted thereon. Propulsion control cams 54 are fixedly mounted on square portion **52*a* of shaft 52, so as to be rotated therewith. Cams 54 have central openings of square shape corresponding to the cross-section of square portion 52***a* of shaft 52.

Each propulsion control cam 54 is adapted to operate a corresponding spring-biased contact finger 58 (FIG. 1) into and out of contact with fixed contact member 60. Each contact finger 58 is provided with roller 58*a*, which engages peripheral edge 54*a* (FIGS. 4 and 8) on its respective cam 54. Peripheral edge 54*a* of each cam 54 includes notch or recess 54*b* therein which, when entered into by roller 58*a*, allows contact finger 58 to engage with fixed contact member 60. When roller 58*a* engages an unnotched portion 54*c* of peripheral edge 54*a*, finger 58 is shifted out of contact with fixed contact member 60.

Fingers 58 and fixed contact members 60 form a plurality of switches 62 which, when closed, send electrical signals to a control processor (not shown). The processor, upon receiving these signals, controls the propulsion of the locomotive. The specific contour of outer peripheral edges 54*a* and their relative angular position with respect to each other is preferably such that contact fingers 58 are operated into and out of bridging contact with fixed contact members 60 in connection with the operation of power handle 12 to provide a desired propulsion profile in both the forward and reverse directions.

Braking controller 70 comprises shaft 72 having a plurality of brake control cams 74 mounted thereon. Brake control cams 74 are fixedly mounted on square portion 72*a* of shaft 72, so as to be rotated therewith. Cams 74 have central openings of square shape corresponding to the cross-section of square portion 72*a* of shaft 72.

Figure 8:
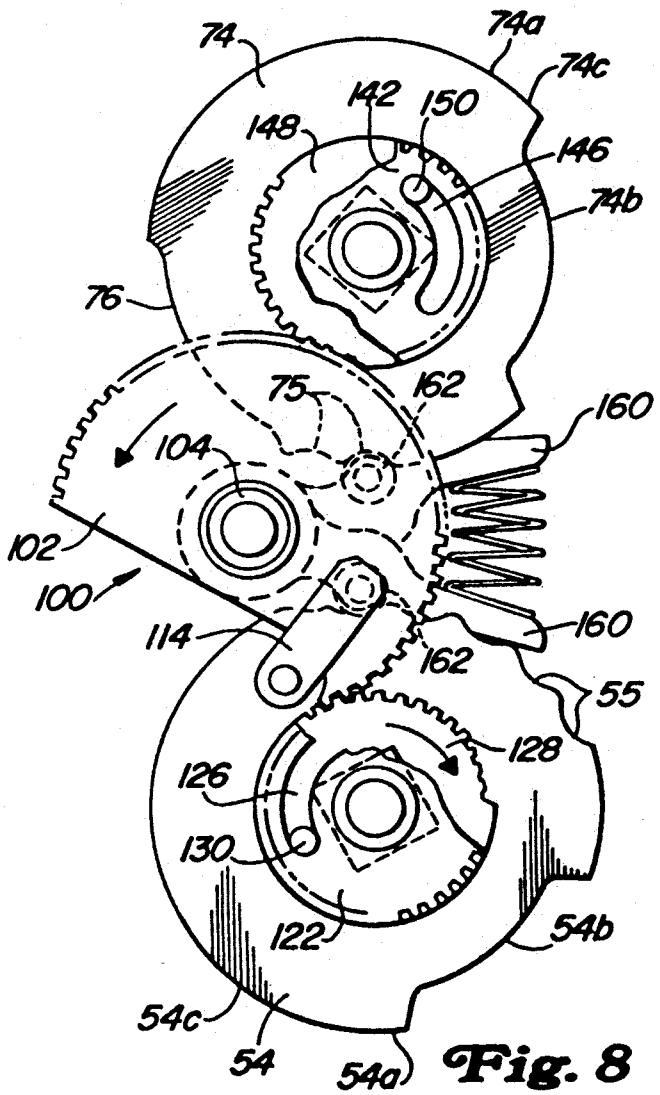
FIG. 8 shows an isolated end view of the indexing mechanism of the present invention being rotated in a counterclockwise direction.
Figure 4:
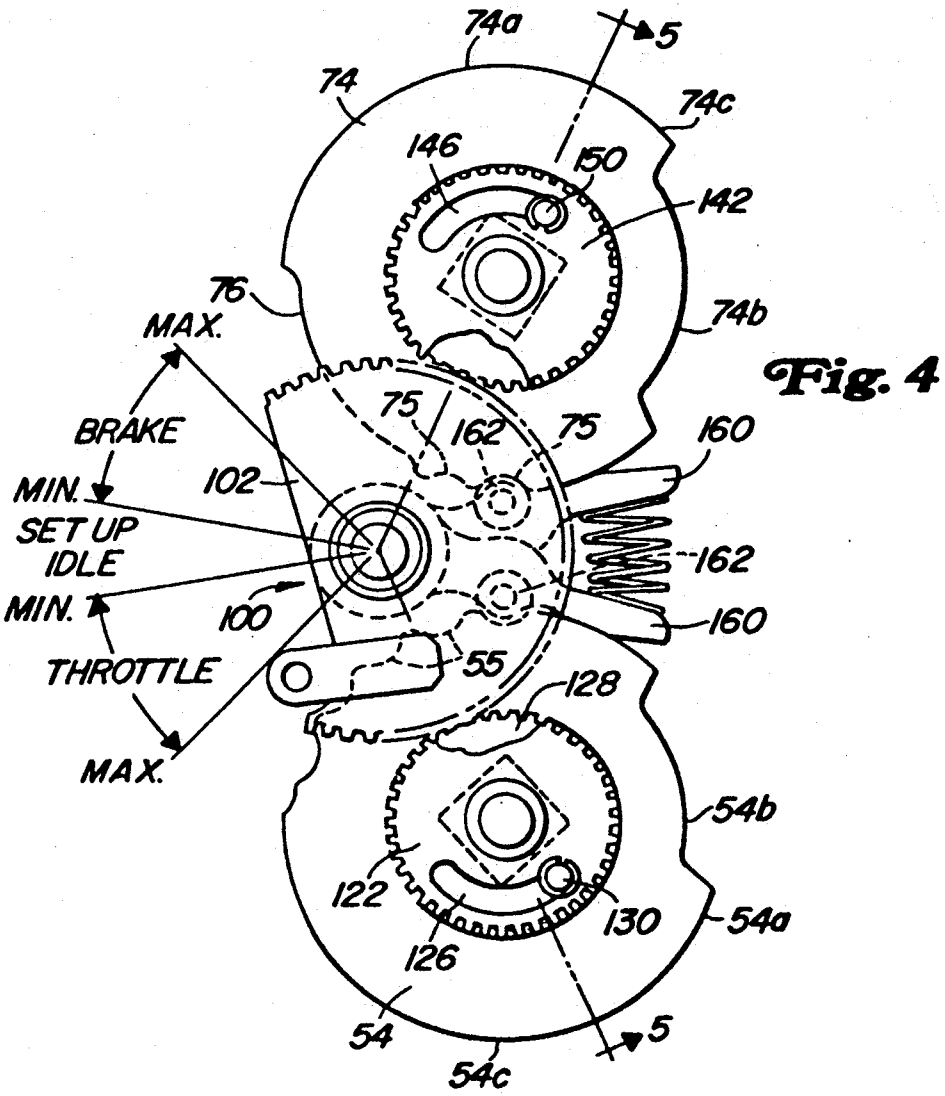
FIG. 4 shows an isolated end view of the propulsion controller, braking controller and the indexing mechanism of the controller shown in FIGS. 1 and 2.

As shown in FIG. 1, each brake control cam 74 is adapted to operate a corresponding contact finger 78 into and out of contact with fixed contact member 80. Each contact finger 78 is provided with roller 78*a* which engages peripheral edge 74*a* of its respective cam 74 (FIGS. 4 and 8). Peripheral edge 74*a* of each cam 74 includes notch or recess 74*b* therein which, when entered into by roller 78*a*, allows contact finger 78 to engage with fixed contact member 80. When roller 78*a* engages an unnotched portion 74*c* of peripheral edge 74*a* of cam 74, finger 78 is shifted out of contact with fixed contact member 80.

Fingers 78 and fixed contact members 80 form a plurality of switches 82 which, when closed, send electrical signals to the control processor (not shown). Additionally, shaft 72 is preferably operatively engaged with a brake control potentiometer (not shown), which is controlled by the rotation of shaft 72. When shaft 72 is rotated, the resistance of the potentiometer is indicative of the amount of shaft rotation. The processor controls the braking function of the locomotive, based on the signals from switches 82 and the resistance of the potentiometer.

Figure 6:
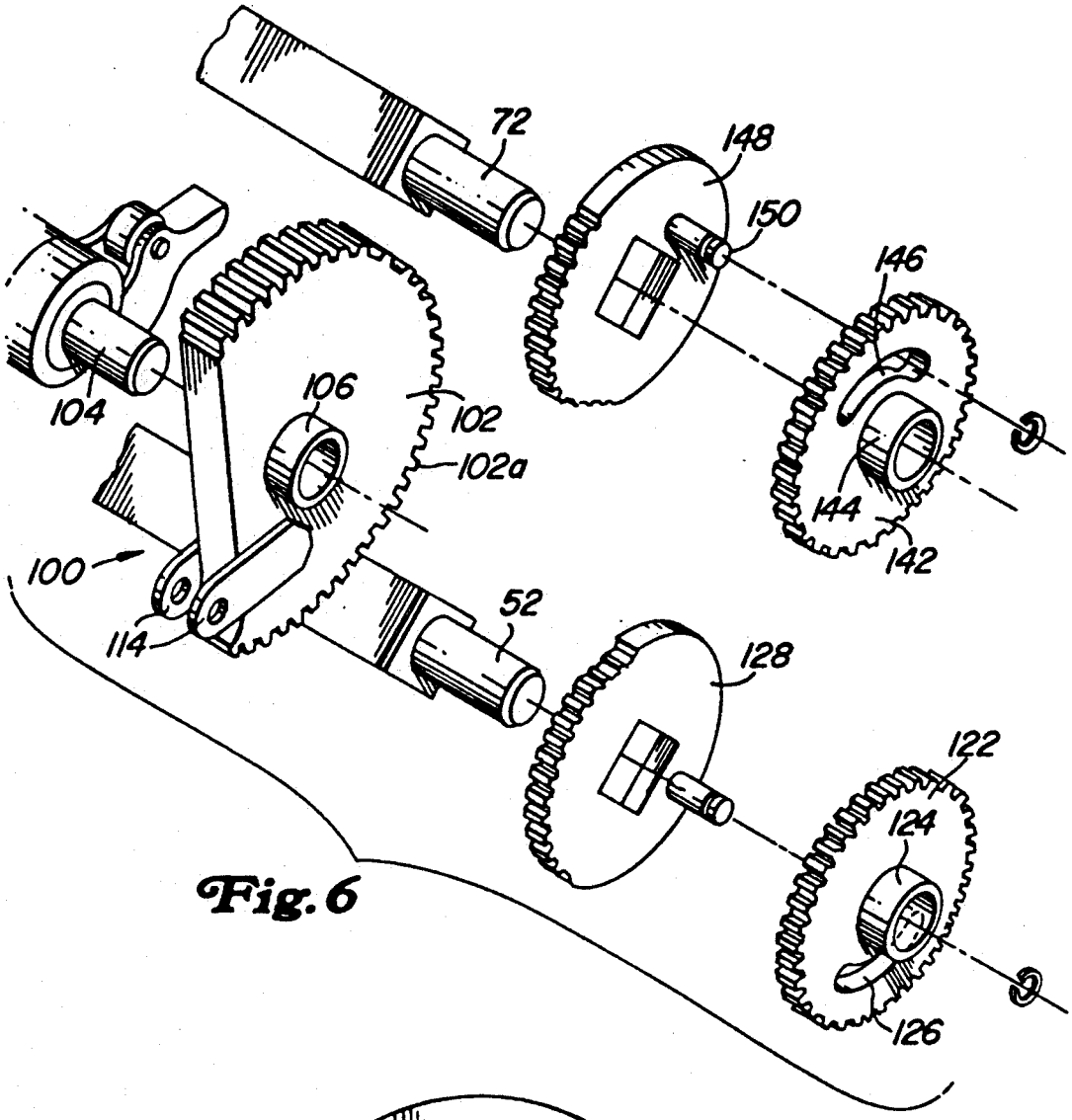
FIG. 6 is an exploded perspective view of the preferred embodiment of the indexing mechanism of the present invention.

With reference to FIGS. 5 and 6, indexing mechanism 100 includes drive gear 102 which is rotatably mounted on shaft 104 by bushing 106 or the like. Drive gear 102 is preferably movable in a counter-clockwise direction for initiating rotational motion of shaft 52, and in a clockwise direction for initiating rotational motion of shaft 72.

With reference to FIG. 1, drive gear 102 is operatively connected to power handle 12 via drive linkage 108. First end 108*a* of linkage 108 is connected by pin 110 to yoke 12*a*, which is fixed to power handle 12. Second end 108*b* of linkage 108 is connected via pin 112 to two lugs 114 which are fixed, e.g., by bolts (not shown), to drive gear 102.

With reference to FIGS. 3 and 6, indexing mechanism 100 further includes first lost motion device 120 mounted onto shaft 52 and operatively engaged with drive gear 102 to transmit rotational motion from drive gear 102 to shaft 52 upon drive gear 102 being rotated in the counterclockwise direction.

First lost motion device 120 preferably includes freewheeling gear 122 having arcuate engagement slot 126 therein. Freewheeling gear 122 is rotatably mounted on shaft 52 by bushing 124 or the like, and preferably engages drive gear 102 at all times. First lost motion device 120 further includes transition gear 128 preferably fixedly mounted onto square portion 52*a* of shaft 52. Transition gear 128 includes engagement pin 130 which extends into arcuate slot 126 and is movable by an end portion of slot 126 when drive gear 102 is rotated in the counterclockwise direction.

Figure 7:
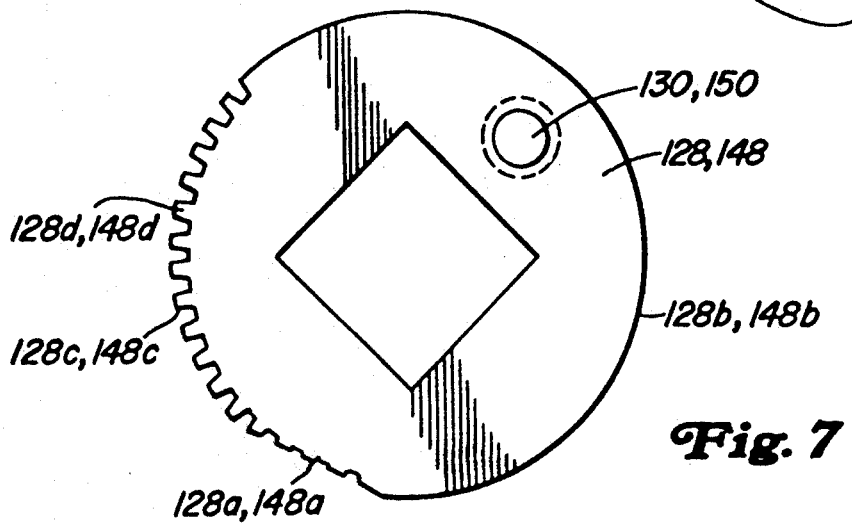
FIG. 7 is an isolated side view of a transition gear of the present invention.

Transition gear 128 further includes transition contour 128*a* (FIG. 7) on outer periphery 128*b*, which is notched or cut-away so as not to be engageable with drive gear 102 when positioned directly adjacent to outer periphery 102*a* of drive gear 102. Also located on outer periphery 128*b* of transition gear 128 is portion 128*c* comprising gear teeth 128*d*. Portion 128*c* of gear 128 is engageable with drive gear 102 when it is positioned directly adjacent to outer periphery 102*a* of drive gear 102.

Indexing mechanism 100 further includes second lost motion device 140 mounted on shaft 72 and operatively engaged with drive gear 102 to transmit rotational motion from drive gear 102 to shaft 72 upon drive gear 102 being rotated in the clockwise direction.

Second lost motion device 140 includes freewheeling gear 142 having arcuate engagement slot 146 therein. Freewheeling gear 142 is rotatably mounted on shaft 72 by bushing 144 or the like, and preferably engages drive gear 102 at all times. Second lost motion device 140 further includes transition gear 148 preferably fixedly mounted on square portion 72*a* of shaft 72. Transition gear 148 includes engagement pin 150 which extends into arcuate slot 146 and is movable by an end portion of slot 146 when drive gear 102 is rotated in the clockwise direction.

Transition gear 148 further includes transition contour 148*a* (FIG. 7) on outer periphery 148*b* which is notched or cut-away so as not to be engageable with drive gear 102 when positioned directly adjacent to outer periphery 102*a* of drive gear 102. Also located on outer periphery 148*b* of transition gear 148 is portion 148*c* comprising gear teeth 148*d*. Portion 148*c* is engageable with drive gear 102 when it is located directly adjacent to outer periphery 102*a* of drive gear 102.

With reference to FIG. 4, power handle 12 is movable in a clockwise direction, causing drive gear 102 to rotate clockwise, thereby applying braking power to the locomotive. Power handle 12 is preferably movable in a clockwise direction from a central idle position, where no braking power is applied, to a set-up position and into a brake control zone where braking power is applied. The amount of braking power is preferably a function of the amount of clockwise rotation of drive gear 102.

Power handle 12 is also movable in a counterclockwise direction, causing drive gear 102 to rotate counterclockwise, thereby applying propulsion to the locomotive. Power handle 12 is preferably movable in a counterclockwise direction from a central idle position into a throttle zone where propulsion is applied to the locomotive. The amount of propulsion is preferably a function of the amount of counterclockwise rotation of drive gear 102.

Preferably, power handle 12 is movable from the idle position to a plurality of discrete drive positions within the throttle zone. In order to provide tactile feedback to the user as power handle 12 is moved to each discrete drive position within the throttle zone, a detent mechanism is preferably provided. The detent mechanism preferably also provides tactile feedback to the user as power handle 12 is moved from the idle position, to the set up position and into the brake zone.

The detent mechanism preferably comprises a plurality of spring-biased pawls 160 (FIG. 4 and 8) rotatably mounted on shaft 104. In the preferred embodiment, first pair of pawls 302 (FIG. 3) is located between the third brake cam and the second propulsion cam (as viewed from right to left in FIG. 3). Additionally, second pair of pawls 304 is preferably located between the first reverser cam and the fourth propulsion cam.

Each propulsion control cam 54 to which pawl 160 is associated preferably includes a plurality of notches 55 (FIGS. 4 and 8) thereon corresponding to the idle position and the plurality of discrete drive positions. Likewise, each brake control cam 74 to which pawl 160 is associated preferably includes two notches 75 and recess 76. The two notches preferably correspond to the idle and set up positions and the recess preferably corresponds to the brake zone. Alternatively, the rise between notches 75 can be removed, producing a recessed area, the edges of which preferably corresponding to the idle and set up positions. Pawls 160 preferably include rollers 162 which engage the plurality of notches on the propulsion control cams and the notches and recess on the brake control cams.

Figure 9:
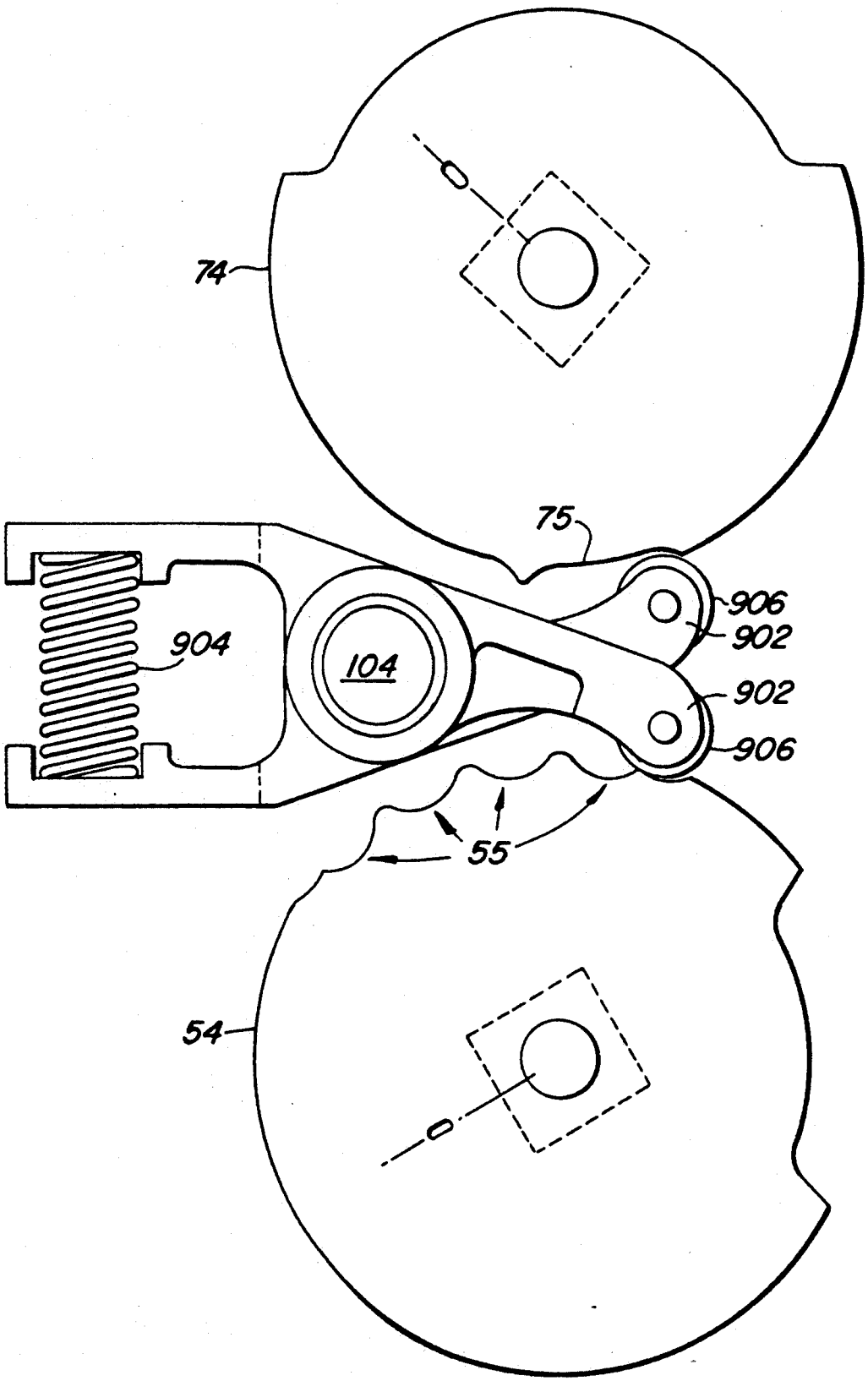
FIG. 9 is an isolated side view of another preferred embodiment of the detent mechanism shown in FIGS. 4 and 8.

Alternatively, as shown with reference to FIG. 9, the detent mechanism comprises a plurality of pawls 902 biased by spring 904. Pawls 902 preferably include rollers 906 which engage the plurality of notches on the propulsion control cams and the notches and recess on the brake control cams.

In order to insure mutually exclusive movement of either the propulsion controller or the braking controller, a throttle-brake interlock is preferably provided. In the preferred embodiment, throttle-brake interlock 1000 is located between the first brake cam and the first propulsion cam (as viewed from right to left in FIG. 3).

Figure 10:
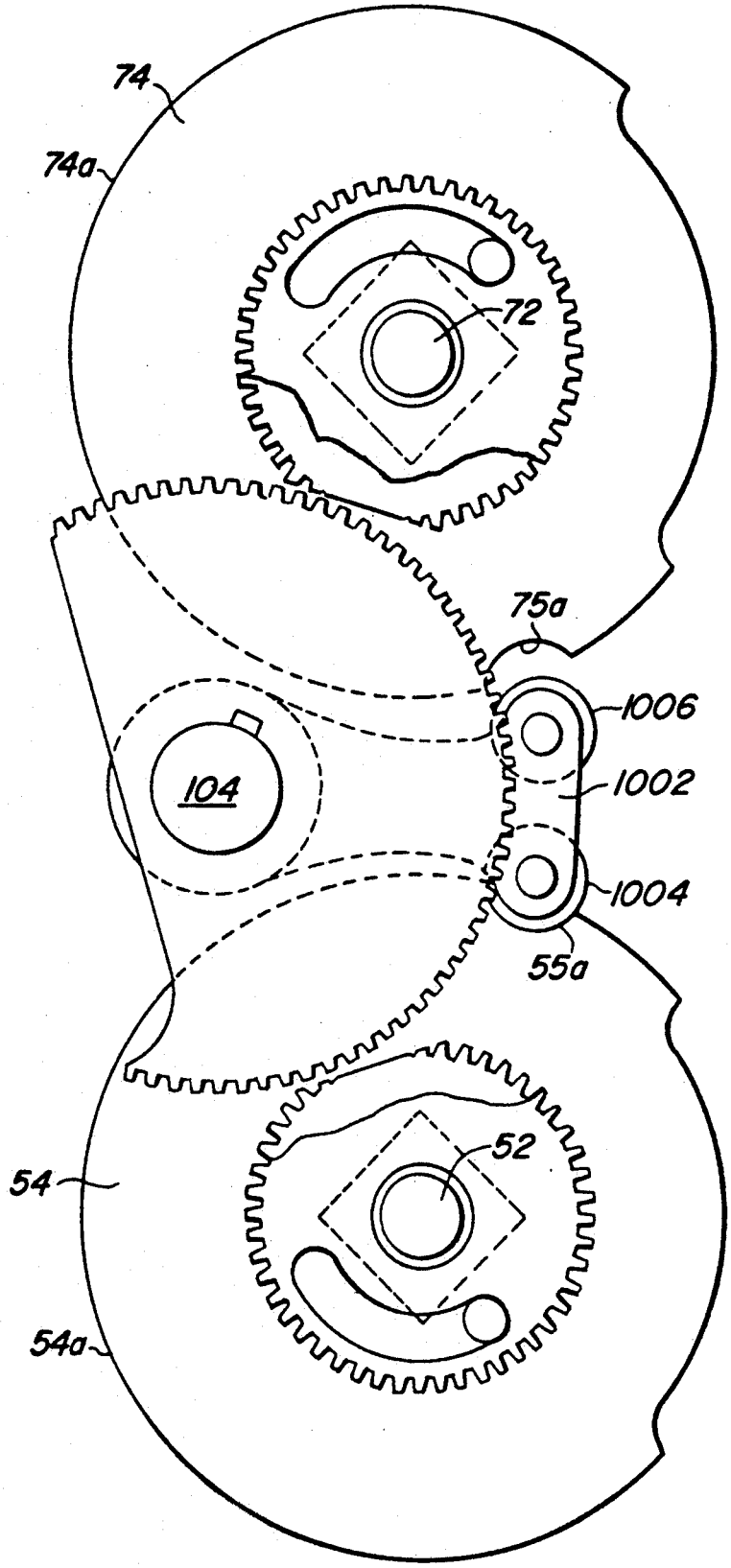
FIG. 10 is an isolated side view of a preferred embodiment of a throttle-brake interlock of the present invention.

With reference to FIG. 10, propulsion control cam 54 includes notch 55*a* and brake control cam 74 includes notch 75*a*. The throttle-brake interlock preferably comprises arm 1002 rotatably mounted on shaft 104. Arm 1002 preferably includes first roller 1004 and second roller 1006 rotatably mounted thereon.

While the braking function is active, brake control cam 74 is in motion and roller 1006 is in contact with the traveling along periphery 74*a* thereof. Arm 1002 is therefore urged towards propulsion control cam 54, causing roller 1004 to seat within notch 55*a*. Rotation of propulsion control cam is therefore precluded.

Once power handle 12 is in the idle position, roller 1006 is aligned with notch 75*a*. Should the propulsion function then become active, propulsion control cam 54 rotates in a clockwise direction, causing roller 1004 to travel along periphery 54*a* thereof. Arm 1002 is thus urged towards brake control cam 74, causing roller 1006 to seat within notch 75*a*, precluding further rotation of the brake control cam.

Referring now to FIGS. 1 through 3, reverser control device 40 preferably comprises a plurality of reverser cams 42, which are rotatably mounted on shaft 72 by bushings 44 or the like. Reverser cams 42 are operatively connected to reverser handle 14 by reverse linkage 46. First end 46*a* of reverse linkage 46 is joined to reverser handle 14 by pin 47. Second end 46*b* of reverse linkage 46 is joined to threaded arm 48 (FIG. 3) which is pinned to the two adjacent cams by a pin (not shown) extending therethrough.

Reverser handle 14 is movable from a central neutral position to a forward or reverse position, permitting an operator to control the direction in which the locomotive travels. As reverser handle 14 is moved, reverser cams 42 are rotated about shaft 72 and actuate switches (not shown). The switches generate a direction control signal which is used by the control processor to control the direction in which the locomotive travels.

The controller preferably also includes an interlock mechanism to help minimize operator error regarding reverser and power handle operation. Specifically, to be able to warm up the engine, the power handle can enter the throttle zone provided the reverser handle is in its neutral position. To engage a direction, however, the power handle must preferably be returned to its neutral position. Once the reverser handle has engaged either the forward or reverse direction, the power handle can be moved throughout the brake and throttle zones. To help prevent movement of the reverser handle while it is engaged in its forward or reverse positions, the reverser handle can preferably be moved only when the power handle is in its neutral position.

Figure 11:
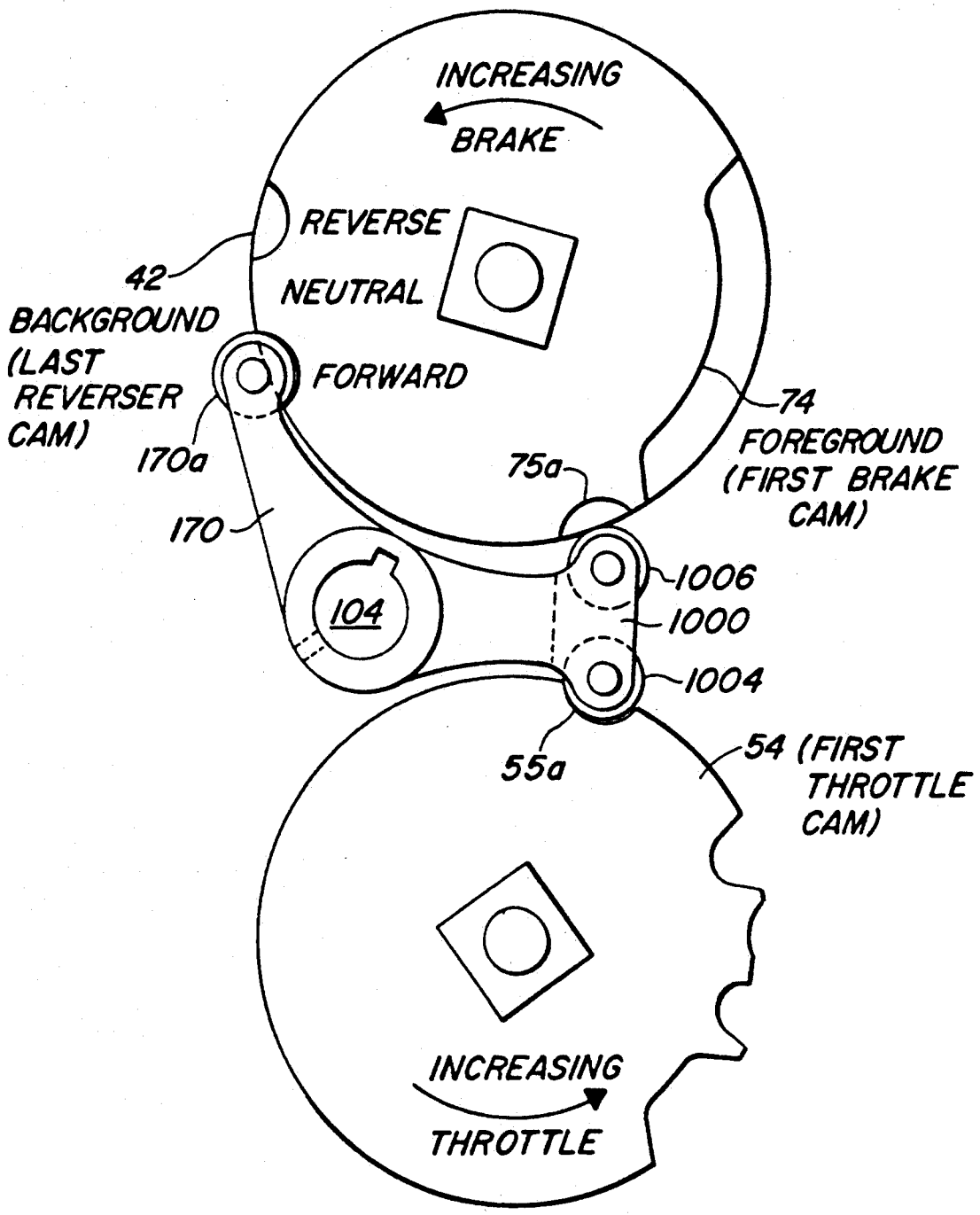
FIG. 11 is an isolated side view of a preferred embodiment of reverser-brake interlock of the present invention and the throttle-brake interlock shown in FIG. 10.
Figure 12:
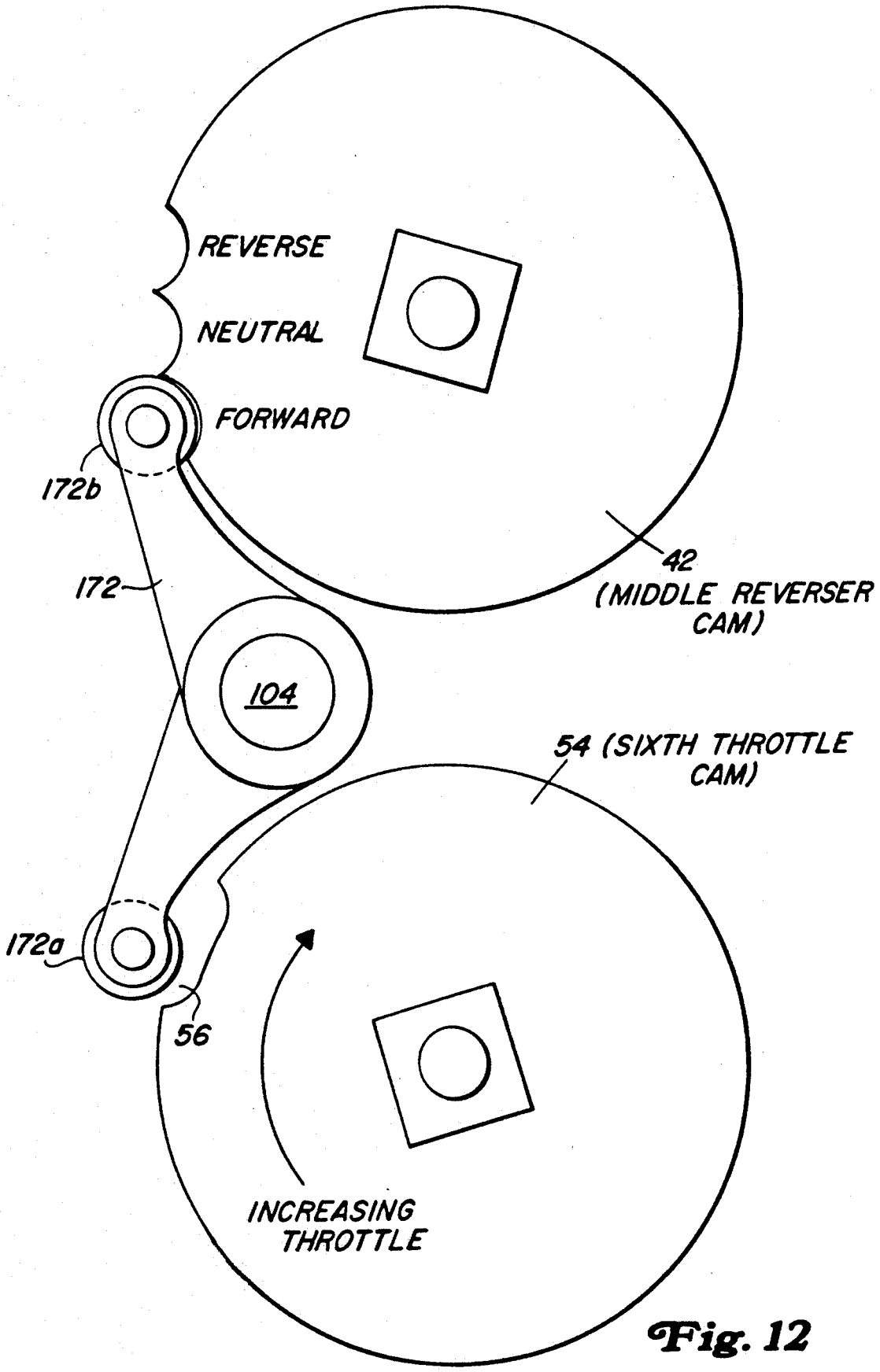
FIG. 12 is an isolated side view of a reverser-throttle interlock of the present invention.

With reference to FIGS. 2, 11 and 12, the interlock mechanism of the present invention preferably comprises a reverser-brake interlock having pawl 170, preferably located adjacent to the last reverser cam (from right to left, FIG. 2), which acts in conjunction with throttle-brake interlock 1000. The interlock mechanism further preferably comprises a reverser-throttle interlock having pawl 172, preferably located between the middle reverser cam and the sixth throttle cam (from right to left, FIG. 2). Pawl 170 and arm 1000 are preferably pinned to shaft 104. Thus, movement of one will result in movement of the other.

When the power handle is in its neutral position, roller 170*a* of pawl 170 (FIG. 11) resides on the peripheral surface of last reverser cam 42 and roller 1006 resides in notch 75*a*. The braking control cam is thus unable to be rotated and dynamic braking is thereby precluded. The throttle control cams, however, are free to rotate, thereby allowing the engine to warm up provided the reverser handle is in its neutral position.

Notch 56 (FIG. 12) allows movement of pawl 172 when roller 172*b* moves between forward, neutral or reverse. While the power handle is in the throttle zone, the peripheral surface of throttle control cam 54, acting on roller 172*a*, will preclude the reverser cam from moving from forward to neutral or reverse, or from reverse to neutral or forward, since notch 56 will not be aligned with roller 172*a*. Thus, to be able to move the reverser handle from neutral to forward or reverse, the power handle must be returned to its idle position.

Once the reverser handle has engaged either the forward or reverse direction, roller 172*a* has no need to be aligned with notch 56 (FIG. 12), and rollers 1004 and 1006 (FIG. 11) are not fixedly seated within notches 75*a* and 55*a*, respectively. Thus, the power handle can be moved through the throttle and brake zones. When in the throttle zone, arm 1000 and rollers 1004 and 1006 preclude braking, as explained in detail above. Similarly, when in the brake zone, arm 1000 and rollers 1004 and 1006 preclude throttle.

When in either the throttle or brake zone, pawl 172 and roller 172*a* and 172*b* preclude the direction from being changed, as explained in detail above. To be able to change directions, the power handle must be in the idle position. When in idle, notch 56 is aligned with roller 172*a*, allowing roller 172*a* an area in which to move when roller 172*b* moves between the forward, neutral and reverse positions.

In operation of controller 10, when reverser handle 14 is in either its forward or reverse position, an operator may move power handle 12 to apply braking power or propulsion power to the locomotive. When power handle 12 is moved counterclockwise from its idle position, drive gear 102 is caused to move counterclockwise, as shown in FIG. 8, resulting in movement of freewheeling gear 122. As freewheeling gear 122 rotates, an end portion of slot 126 moves pin 130, causing rotation of transition gear 128 and shaft 52. Rotation of transition gear 128 results in second outer portion 128*c* engaging with gear teeth 102*a* located on drive gear 102. As shaft 52 rotates, propulsion control cams 54 located thereon are rotated, causing appropriate switches 62 to be actuated. This results in a desired amount of propulsion power being delivered to the locomotive.

As power handle 12 is moved counterclockwise from its idle position, drive gear 102 causes freewheeling gear 142 to rotated therewith. Its slot, however, does not engage pin 150 located on transition gear 148. Consequently, transition gear 148 and shaft 72 remain stationary during rotation of shaft 52.

If an operator wishes to apply braking power after initially applying propulsion power, the operator need only rotate power handle 12 clockwise. This will cause drive gear 102 to rotate clockwise, resulting in freewheeling gear 122 and transition gear 128 rotating therewith. Transition gear 128, however, will only be rotated until second portion 128*c* no longer engages with drive gear 102. This occurs as power handle 12 moves from its first drive position to its idle position.

As power handle 12 is moved clockwise from its idle position to its set up position, slot 146 on freewheeling gear 142 will move pin 150 causing transition gear 148 to begin to rotate. As transition gear 148 rotates, second outer portion 148*c* engages with drive gear 102. Rotation of transition gear 148 also causes corresponding rotation of its associated shaft 72 and brake control cams 74 located on shaft 72. As power handle 12 moves from its set up position to its brake control zone, shaft 72 and its brake control cams 74 located thereon will continue to rotate causing actuation of appropriate switches 82 and the potentiometer. This results in a desired amount of braking power being delivered to the locomotive.

If the operator wishes to return power handle 12 to its idle position after applying braking power, the operator need only move power handle 12 counterclockwise. This will cause drive gear 102 to rotate counterclockwise, resulting in rotation of freewheeling gear 142 and transition gear 148. Transition gear 148 will only be rotated until second portion 148*c* no longer engages with drive gear 102. This occurs as power handle 12 moves from its set up position to its idle position.

When power handle 12 is in its idle position, the operator may move reverser handle 14 to change the direction in which the locomotive travels. Upon movement of reverser handle 14, reverser cams 42 will rotate about shaft 72 to actuate the appropriate direction control switches. This will result in the locomotive being driven in the desired travel direction.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What is claimed is:

1. A power controller for controlling propulsion and braking functions comprising:

a rotatable first lost motion device, including a transition gear having a transition contour;

a propulsion controller, operatively connected to the first lost motion device, for controlling the propulsion function based on the rotation of the first lost motion device;

a rotatable second lost motion device;

a braking controller, operatively connected to the second lost motion device, for controlling the braking function based on the rotation of the second lost motion device;

a drive mechanism movable within at least a first and a second range of motion and operatively connected to and causing rotation of the first lost motion device when the drive mechanism is moved within the first range of motion, the drive mechanism further operatively connected to and causing rotation of the second lost motion device when the drive mechanism is moved within the second range of motion;

a power handle operatively connected to the drive mechanism to allow a user to move the drive mechanism within the first or the second range of motion;

a throttle-brake interlock, operatively connected to the propulsion controller and the braking controller, for providing mutual exclusivity as between the propulsion function and the braking function.

2. The power controller of claim 1, wherein the drive mechanism is further movable within a third range of motion, located between the first and the second range of motion, to provide a transition between the propulsion and the braking functions.

3. The power controller of claim 1, wherein the first lost motion device comprises:

an engagement pin operatively connected to the transition gear;

a freewheeling gear operatively connected to the drive mechanism, the freewheeling gear having an arcuate slot therein for receiving the engagement pin;

wherein movement of the drive mechanism within the first range of motion causes rotation of the freewheeling gear, causing an end portion of the slot to engage the engagement pin, thereby rotating the transition gear, and wherein movement of the drive mechanism within the second range of motion causes rotation of the freewheeling gear, causing the engagement pin to travel within at least a portion of the arcuate slot so as not to engage the engagement pin, thereby precluding rotation of the transition gear by the freewheeling gear.

4. The power controller of claim 1, wherein the second lost motion device comprises:

a transition gear operatively connected to the braking controller, the transition gear having an engagement pin affixed thereto;

a freewheeling gear operatively connected to the drive mechanism, the freewheeling gear having an arcuate slot therein for receiving the engagement pin;

wherein movement of the drive mechanism within the second range of motion causes rotation of the freewheeling gear, causing an end portion of the slot to engage the engagement pin, thereby rotating the transition gear, and wherein movement of the drive mechanism within the first range of motion causes rotation of the freewheeling gear, causing the engagement pin to travel within at least a portion of the arcuate slot, thereby precluding rotation the transition gear by the freewheeling gear.

5. The power controller of claim 1, wherein the drive mechanism comprises a drive gear.

6. A power controller for controlling the propulsion and braking functions comprising:

a rotatable first lost motion device, including a transition gear having a transition contour;

a propulsion controller, operatively connected to the first lost motion device, for controlling the propulsion function based on the rotation of the first lost motion device;

a rotatable second lost motion device;

a braking controller, operatively connected to the second lost motion device, for controlling the braking function based on the rotation of the second lost motion device;

a drive mechanism movable within at least a first and a second range of motion and operatively connected to and causing rotation of the first lost motion device when the drive mechanism is moved within the first range of motion, the drive mechanism further operatively connected to and causing rotation of the second lost motion device when the drive mechanism is moved within the second range of motion; and a detent mechanism, operatively connected to the propulsion controller, for providing tactile feedback to a user indicative of incremental motion of the drive mechanism within the first range of motion.

7. The power controller of claim 1, further comprising:

a detent mechanism operatively connected to the braking controller to provide tactile feedback to a user indicative of incremental motion of the drive mechanism within the second range of motion.

8. The power controller of claim 1, further comprising:

at least one rotatable propulsion control cam having a peripheral surface and a notch located thereon, wherein the braking controller includes at least one rotatable brake control cam having a peripheral surface and a notch located thereon, the throttle-brake interlock comprising:

a movable arm having a first and a second roller rotatably mounted thereon, wherein rotation of the propulsion control cam causes the second roller to contact the peripheral surface of the propulsion control cam and the first roller to be located in the notch of the brake control cam, thereby precluding rotation of the brake control cam, and wherein rotation of the brake control cam causes the first roller to contact the peripheral surface of the brake control cam and the second roller to be located in the notch of the propulsion control cam, thereby precluding rotation of the propulsion control cam.

9. A locomotive controller having a reverser handle operatively connected to a reverser control device for controlling the direction of locomotive travel, and a power handle operatively connected to a power control device for controlling propulsion and braking functions of the locomotive, the power control device comprising:

a rotatable first lost motion device;

a propulsion controller operatively connected to the first lost motion device, the propulsion controller controlling the propulsion of the locomotive based on the rotation of the first lost motion device;

a rotatable second lost motion device, including a transition gear having a transition contour, operatively connected to the braking controller;

a braking controller operatively connected to the second lost motion device, the braking controller controlling the braking of the locomotive based on the rotation of the second lost motion device;

a drive mechanism movable within at least a first and a second range of motion, the drive mechanism operatively connected to and causing rotation of the first lost motion device when the drive mechanism is moved within the first range of motion, the drive mechanism further operatively connected to and causing rotation of the second lost motion device when the drive mechanism is moved within the second range of motion;

the power handle operatively connected to the drive mechanism to allow the user to move the drive mechanism within the first or the second range of motion;

a throttle-brake interlock, operatively connected to the propulsion controller and the braking controller, for providing mutual exclusivity as between the propulsion function and the braking function.

10. The power control device of claim 9, wherein the drive mechanism is further movable within a third range of motion, located between the first and the second range of motion, to provide a transition between the propulsion and the braking functions.

11. The power control device of claim 9, wherein the first lost motion device comprises:

a transition gear operatively connected to the propulsion controller, the transition gear having an engagement pin affixed thereto;

a free wheeling gear operatively connected to the drive mechanism, the freewheeling gear having an arcuate slot therein for receiving the engagement pin;

wherein movement of the drive mechanism within the first range of motion causes rotation of the freewheeling gear, causing an end portion of the slot to engage the engagement pin, thereby rotating the transition gear, and wherein movement of the drive mechanism within the second range of motion causes rotation of the freewheeling gear, causing the engagement pin to travel within at least a portion of the arcuate slot, thereby precluding rotation the transition gear by the freewheeling gear.

12. The power control device of claim 9, wherein the second lost motion device comprises:

an engagement pin operatively connected to the transition gear;

a freewheeling gear operatively connected to the drive mechanism, the freewheeling gear having an arcuate slot therein for receiving the engagement pin;

wherein movement of the drive mechanism within the second range of motion causes rotation of the freewheeling gear, causing an end portion of the slot to engage the engagement pin, thereby rotating the transition gear, and wherein movement of the drive mechanism within the first range of motion causes rotation of the freewheeling gear, causing the engagement pin to travel within at least a portion of the arcuate slot so as not to engage the engagement pin, thereby precluding rotation the transition gear by the freewheeling gear.

13. The power control device of claim 9, wherein the drive mechanism comprises a drive gear.

14. The power controller of claim 9, wherein the propulsion controller includes at least one rotatable propulsion control cam having a peripheral surface and a notch located thereon, and the braking controller includes at least one rotatable brake control cam having a peripheral surface and a notch located thereon, the throttle-brake interlock comprising:

a movable arm having a first and a second roller rotatably mounted thereon, wherein rotation of the propulsion control cam causes the second roller to contact the peripheral surface of the propulsion control cam and the first roller to be located in the notch of the brake control cam, thereby precluding rotation of the brake control cam, and wherein rotation of the brake control cam causes the first roller to contact the peripheral surface of the brake control cam and the second roller to be located in the notch of the propulsion control cam, thereby precluding rotation of the propulsion control cam.

15. A power controller for controlling the propulsion and braking functions of a locomotive comprising:

a propulsion control device including at least one rotatable propulsion control cam having a peripheral surface and a notch located thereon, wherein control of the propulsion function is based on the rotation of the propulsion control cam;

a brake control device including at least one rotatable brake control cam having a peripheral surface and a notch located thereon, wherein control of the braking function is based on the rotation of the brake control cam; and a throttle-brake interlock for providing mutual exclusivity as between the propulsion function and the braking function, the throttle-brake interlock comprising a movable arm having a first and a second roller rotatably mounted thereon, wherein rotation of the propulsion control cam causes the second roller to contact the peripheral surface of the propulsion control cam and the first roller to be located in the notch of the brake control cam, thereby precluding rotation of the brake control cam, and wherein rotation of the brake control cam causes the first roller to contact the peripheral surface of the brake control cam and the second roller to be located in the notch of the propulsion control cam, thereby precluding rotation of the propulsion control cam.

16. A locomotive controller having a reverser handle operatively connected to a reverser control device for controlling the direction of locomotive travel, and a power handle operatively connected to a power control device for controlling the propulsion and braking functions of the locomotive, the power control device comprising:

a propulsion control device including at least one rotatable propulsion control cam having a peripheral surface and a notch located thereon, wherein control of the propulsion function is based on the rotation of the propulsion control cam;

a brake control device including at least one rotatable brake control cam having a peripheral surface and a notch located thereon, wherein control of the braking function is based on the rotation of the brake control cam; and a throttle-brake interlock to provide mutual exclusivity as between the propulsion function and the braking function, the throttle-brake interlock comprising a movable arm having a first and second roller rotatably mounted thereon, wherein rotation of the propulsion control cam causes the second roller to contact the peripheral surface of the propulsion control cam and the first roller to be located in the notch of the brake control cam, thereby precluding rotation of the brake control cam, and wherein rotation of the brake control cam causes the first roller to contact the peripheral surface of the brake control cam and the second roller to be located in the notch of the propulsion control cam, thereby precluding rotation of the propulsion control cam.

17. a power controller for controlling the propulsion and braking functions of a locomotive comprising:

a propulsion control device including at least one rotatable propulsion control cam having a peripheral surface and a notch located thereon, wherein control of the propulsion function is based on the rotation of the propulsion control cam;

a brake control device including at least one rotatable brake control cam having a peripheral surface and a notch located thereon, wherein control of the braking function is based on the rotation of the brake control cam; and a drive mechanism movable within at least a first and a second range of motion, the drive mechanism operatively connected to the propulsion control device for rotating the propulsion control cam when the drive mechanism is moved within the first range of motion, the drive mechanism further operatively connected to the brake control device for rotating the brake control cam when the drive mechanism is moved within the second range of motion;

a power handle, operatively connected to the drive mechanism, for moving the drive mechanism within the first or the second range of motion; and a throttle-brake interlock for providing mutual exclusivity as between the propulsion function and the braking function, the throttle-brake interlock comprising a movable arm having a first and a second roller rotatably mounted thereon, wherein rotation of the propulsion control cam causes the second roller to contact the peripheral surface of the propulsion control cam and the first roller to be located in the notch of the brake control cam, thereby precluding rotation of the brake control cam, and wherein rotation of the brake control cam causes the first roller to contact the peripheral surface of the brake control cam and the second roller to be located in the notch of the propulsion control cam, thereby precluding rotation of the propulsion control cam.

18. A locomotive controller having a reverser handle operatively connected to a reverser control device to allow a user to control the direction of locomotive travel, and a power handle operatively connected to a power control device for controlling the propulsion and braking functions of the locomotive, the power control device comprising:

a propulsion control device including at least one rotatable propulsion control cam having a peripheral surface and a notch located thereon, wherein control of the propulsion function is based on the rotation of the propulsion control cam;

a brake control device including at least one rotatable brake control cam having a peripheral surface and a notch located thereon, wherein control of the braking function is based on the rotation of the brake control cam; and a drive mechanism, movable within at least a first and a second range of motion, and being operatively connected to the propulsion control device for rotating the propulsion control cam when the drive mechanism is moved within the first range of motion, the drive mechanism being further operatively connected to the brake control device for rotating the brake control cam when the drive mechanism is moved within the second range of motion;

the power handle being operatively connected to the drive mechanism for moving the drive mechanism within the first or the second range of motion; and a throttle-brake interlock for providing mutual exclusivity as between the propulsion function and the braking function, the throttle-brake interlock comprising a movable arm having a first and a second roller rotatably mounted thereon, wherein rotation of the propulsion control cam causes the second roller to contact the peripheral surface of the propulsion control cam and the first roller to be located in the notch of the brake control cam, thereby precluding rotation of the brake control cam, and wherein rotation of the brake control cam causes the first roller to contact the peripheral surface of the brake control cam and the second roller to be located in the notch of the propulsion control cam, thereby precluding rotation of the propulsion control cam.

19. A two handle controller for a locomotive comprising:

first controller means comprising a plurality of throttle cams mounted to a first shaft for actuating speed control contacts upon rotation of the first shaft, the speed control contacts controlling propulsion power for the locomotive;

second controller means comprising a plurality of braking cams mounted to a second shaft for actuating braking control contacts upon rotation of the second shaft, the braking control contacts controlling braking power for the locomotive;

first actuating means comprising a first handle operatively connected to the first and second shafts for selectively and alternatively rotating one of the first and second shafts, thereby controlling the propulsion power and the braking power for the locomotive;

a plurality of reverser control cams rotatably mounted onto the second shaft for actuating reverser control contacts upon being rotated on the second shaft, the reverse control contacts controlling the direction in which the locomotive travels; and second actuating means comprising a second control handle operatively connected to the reverser control cams for rotating the reverser control cams, thereby controlling the direction in which the locomotive travels.

* * * * *